US006600262B1

(12) United States Patent
Iida et al.

(10) Patent No.: US 6,600,262 B1
(45) Date of Patent: Jul. 29, 2003

(54) FIELD EMISSION TYPE CATHODE AND ELECTRON EMITTING APPARATUS USING PILED PLATELIKE PARTICLES

(75) Inventors: Koichi Iida, Kanagawa (JP); Ichiro Saito, Tokyo (JP); Shinichi Tachizono, Chiba (JP); Takeshi Yamagishi, Chiba (JP)

(73) Assignees: Sony Corporation (JP); Hitachi Powdered Metals Co. Ltd. (JP)

( * ) Notice: Subject to any disclaimer, the term of this patent is extended or adjusted under 35 U.S.C. 154(b) by 0 days.

(21) Appl. No.: 09/458,830

(22) Filed: Dec. 13, 1999

(30) Foreign Application Priority Data

Dec. 16, 1998 (JP) ..... P10-357928

(51) Int. Cl.[7] ..... H01J 63/04
(52) U.S. Cl. ..... 313/495; 313/309; 313/336
(58) Field of Search ..... 313/309, 310, 313/336, 495, 496

(56) References Cited

U.S. PATENT DOCUMENTS 3,936,697 A * 2/1976 Scott ..... 313/300
5,534,884 A 7/1996 Mase et al. ..... 345/87
5,675,216 A * 10/1997 Kumar et al. ..... 313/491
5,777,427 A * 7/1998 Tanaka et al. ..... 313/309
6,356,014 B2 * 3/2002 Xu et al. ..... 313/309
6,400,091 B1 * 6/2002 Deguchi et al. ..... 313/495

FOREIGN PATENT DOCUMENTS

| | | |
|---|---|---|
| EP | 0 435 701 A2 | 12/1990 |
| EP | 0 689 181 A1 | 6/1995 |
| EP | 0 675 519 A1 | 10/1995 |
| EP | 0 718 864 A1 | 6/1996 |
| EP | 0 725 415 A2 | 8/1996 |
| EP | 10149760 | 6/1998 |
| WO | 97/04436 | 2/1997 |

OTHER PUBLICATIONS

EPO Search Report of Apr. 12, 2002.

* cited by examiner

*Primary Examiner*—Ashok Patel
*Assistant Examiner*—Glenn Zimmerman
(74) *Attorney, Agent, or Firm*—Rader, Fishman & Grauer, PLLC; Ronald P. Kananen

(57) ABSTRACT

The field emission type cathode. (K) is made as the multi-layered structure (33) in which the conductive platelike corpuscles 30 are piled, whereby an edge portion of end surface of a field emission type cathode K for emitting electrons is formed sharply and easily.

4 Claims, 8 Drawing Sheets

FIELD EMISSION TYPE CATHODE AND ELECTRON EMITTING APPARATUS USING PILED PLATELIKE PARTICLES

BACKGROUND OF THE INVENTION

1. Field of the Invention

The present invention relates to a field emission type cathode, an electron emitting apparatus and a process for manufacturing the electron emitting apparatus.

2. Description of the Related Art

Various kinds of electron emitting apparatus having a field emission type cathode, e.g. plane type display device, i.e. panel type display device have been proposed. In order to display a bright picture, a cathode ray tube type structure in which an electron beam bombards a fluorescent screen to emit a light is generally adopted.

The plane type display device having this cathode ray tube type structure is such that, for example, as proposed in Patent Gazette of Laying-Open No. Hei 1-173555, a plurality of thermionic emission type cathodes, i.e. filaments are provided opposite to the fluorescent screen and the thermious produced by this cathode and the secondary electrons thereby are directed towards the fluorescent screen to cause the electron beam to excite the fluorescent screen of respective colours depending on a video signal for light emission. In this case, as the size of screen becomes large, such structure is adopted that the filaments are provided in common to a large number of pixels, namely, a large number of fluorescencer trio of red, green and blue forming the fluorescent screen.

Therefore, particularly with the large-sizing of the screen, the layout and construction of the filaments become complicated and besides, the filament itself becomes elongated.

Moreover, in order to make the size of plane type display device small, it has been practiced to make short of an electron gun or make large of a deflection angle of electron for aiming at shortening its depth. With the recent large-sizing of the plane type display device, the development of a thin structure of plane type display device is further desired.

On the other hand, in the conventional plane type display device, such a plane type display device is proposed that employs the field emission type cathode, the so-called cold cathode. An example of such plane type display device structure will be described below with reference to the drawings.

The plane type display device 100 shown in FIG. 1 is comprised of a body 102 of plane type white colour light emitting display device having a white colour light emitting fluorescent screen 101 and field emission type cathodes K arranged opposite thereto as well as a plane type colour shutter 103 arranged adjacent or opposite to the front face of the screen 101 on its arranged side.

As shown in FIG. 1, the display device body 102 is constructed in such a manner that a transparent front panel 104 and a rear panel 105 oppose to each other through a spacer (not shown) holding a predetermined space between both panels 104 and 105 and the peripherys thereof are sealed airtightly by the glass frit, etc. to form a flat space between the panels 104 and 105.

On the inner surface of the front panel 104 is formed the white colour light emitting screen 101 which is made by applying previously a white colour light emitting fluorescencer entirely, and its surface is coated with a metal-backed layer 106 of aluminum film, etc. as in the ordinary cathode ray tube.

On the other hand, on the inner surface of the rear panel 105 are arranged and mounted in parallel a great number of cathode electrodes 107 which, for example, extend vertically in the shape of belts.

These cathode electrodes 107 are covered with an insulation layer 108, on which gate electrodes 109 that extend, for example, in the horizontal direction nearly perpendicular to the extension direction of cathode electrodes 107 are arranged in parallel.

At intersections between each electrode 107 and each gate electrode 109 are bored openings 110, in which conical field emission type cathodes K are formed on the cathodes 107, respectively.

This field emission type cathode K is made of such materials that electron emission occurs due to the tunnel effect by impressing the electric field, e.g. on the level of $10^6$ to $10^7$ [v/cm] on molybdenum, tungsten, chromium and so on.

For better understanding the construction of cathode structure including the field emission type cathode K and the gate electrode, etc. forming the prior art plane type display device will be described together with an example of its manufacturing process in reference to manufacturing process diagrams of FIG. 2 to FIG. 5.

First of all, as described with FIG. 1, the cathode electrodes 107 are formed on the inner surface of the rear panel 105 along one direction, e.g. the vertical scanning direction.

These cathode electrodes 107 are formed into a predetermined pattern, e.g. by evaporating or sputtering a metal layer of chromium, etc. entirely And then etching it selectively by photolithography.

Next, as shown in FIG. 2, this patterned cathode electrodes 107 are coated entirely with the insulation layer 108 by sputtering, etc. and further on this layer a metal layer 111 becoming finally the gate electrodes 109 is formed, e.g. by evaporating or sputtering the metals of high melting point such as molybdenum, tungsten, etc.

As shown in FIG. 3 though not shown, a resist pattern by the photoresist, etc. is formed and using this as a mask the anisotropic etching, e.g. RIE (reactive ion-beam etching) is carried out on the metal layer 111 to form into the predetermined pattern, namely, to form the beltlike gate electrode 109 extending in the horizontal direction perpendicular to the extension of the cathode electrode 107 shown in FIG. 1. At the same time, at the intersections between the gate electrodes 109 and the cathode electrodes 107, for example, a plurality of small holes 111*h* are bored, respectively.

Next, though these small holes 111*h*, for example, a chemical etching which exhibits no etching property to the gate electrode 109, i.e. the metal layer 111 but exhibits the isotropic etching property to the insulation layer 108 is carried out to form cavities 112 having an opening width greater than that of the small holes 111*h* with a depth over a whole thickness of the insulation layer 108.

In this way, as shown in FIG. 1, at the intersections between the cathode electrodes 107 and the gate electrodes 109 are formed the openings 110 including the cavities 112 and the small holes 111*h*.

Next, as shown in FIG. 4, the gate electrode 109 is covered with a metal layer 113 made of e.g. aluminum, nickel, and so forth by an oblique evaporation. This oblique evaporation is carried out while the rear panel 105 is rotated in its plane to form round holes 114 having a conical inner circumference around the small holes 111*h*.

In this case, the evaporation of metal layer 113 is carried out at such a selected angle that the inside of cavities 112 may not be coated through the small holes 111*h*.

Subsequently, a field emission type cathode material, namely, a metal having a high melting point and a low work function such as tungsten, molybdenum, etc. is adhered through the round holes 114 on the cathode electrode 107 inside the cavities 112 at right angles to this cathode electrode surface by evaporation, sputtering and so on. In this case, although the evaporation is carried out at right angles, because that cathode material forms such a slant face that follows a slant face of the metal layer 113 around the round holes 114, when reaching some thickness, the round holes 114 turn into blocked conditions. Consequently, conical dotlike cathodes K each of which has a triangular section are formed on the cathode electrode 107 within each cavity 112.

Thereafter, as shown in FIG. 5, the metal layer 113 and the cathode material formed thereon shown in FIG. 4 are removed, thereby causing the conical dotlike cathodes K each having a triangular section to be formed inside the opening 110 on the beltform, or stripeform cathode electrodes 107.

The cathodes K are surrounded by the insulation layer 108 and therefore insulated electrically from the cathode electrode 107. In opposition to each cathode K are arranged the gate electrodes 109 through which the aforesaid small holes 111*h* are bored as an electron passing holes. In this way, the cathode structure is constructed.

The cathode structure in which the field emission type cathode K is thus formed on the cathode electrode 107 and the gate electrode 109 is further formed above and across the cathode K is arranged in opposition to the white colour screen 101.

In the thus constructed display device body 102, the fluorescent screen 101, i.e. the metal-backed layer 106 is given a high anode voltage being positive to the cathode and also, for example, between the cathode electrode 107 and the gate electrode 109 is impressed a voltage which enables electrons to be emitted sequentially from the field emission type cathode at their intersection. For example, a voltage of 100 v relative to the cathode electrode 107 impressed on the gate electrode 109 is modulated in sequence according to display contents in order to direct the resulting electron beam from the tip of cathode K towards the white colour fluorescent screen 101.

In this way, a white colour image of light emitting pattern corresponding to each colour can be obtained in the time division manner by the display device body 102, and at the same time the colour shutter 103 is switched in synchronism with that time division display to derive a light corresponding to each colour.

Thus, optical images of red, green and blue are derived in sequence to display a colour picture as a whole.

As described above, in the plane type display device 100 having the conventional structure shown in FIG. 1, the field emission type cathode K opposing to the fluorescent screen is formed into a cone whose section is a triangular form due to the manufacturing process described referring to FIG. 2 to FIG. 5, thus causing the electric field to concentrate on the tip of the cone for raising the electron emission.

However, with the development of high technology of today, it is desired to make more efficiently sharp the electron emitting portion of the field emission type cathode K forming this plane type display device.

Moreover, when the cathode K is formed as described referring to FIGS. 2 to 5, its tip will have a shape whose radius of curvature is relatively gradual to the extent that the radius of curvature at the tip is dozens of nm, e.g. about sixty nm. In order to aim at the latest high resolution, it is needed to form this further finely for efficient electric field concentration and electron emission.

SUMMARY OF THE INVENTION

Thus, the present inventors et al have repeated studying devotedly and, as a result, come to provide a field emission type cathode, an electron emitting apparatus and a process for manufacturing the electron emitting apparatus in which the field emission type cathode K forming the plane type display device is made finer and sharper to enable further efficient concentration of electric field.

The field emission type cathode according to the present invention has a multilayered structure in which conductive platelike particles are piled.

The electron emitting apparatus according to the present invention is such that the field emission type cathodes are arranged in opposition to the fluorescent screen and each of the cathodes has a multilayered structure in which the conductive platelike particles are piled. By applying a predetermined electric field to the cathode, electrons will be emitted from its end surface.

The process for manufacturing the electron emitting apparatus according to the present invention has steps of forming a pile of layers of conductive platelike particles made into the multilayered structure by piling the conductive platelike particles on the field emission type cathode forming surface constituting the electron emitting apparatus, and forming an edge portion for concentrating the electric field on the end surface of layered pile of platelike particles by pattern-etching the layered pile of platelike particles.

That is, according to the present invention, because the field emission type cathode K is made up of the layered pile of platelike particles, the electron emitting portion of the cathode K is made finer and sharper, thereby causing the efficient concentration of electric field and enhancing the efficiency of electron emission.

DESCRIPTION OF THE PREFERRED EMBODIMENTS

The field emission type cathode according to the present invention is formed into the multilayered structure in which the conducting platelike particles are piled.

The electron emitting apparatus according to the present invention is such that the field emission type cathodes are arranged in opposition to the fluorescent screen and each of them has the multilayered structure in which the conductive platelike particles are piled. It is arranged that a predetermined electric field is applied to the cathode, thereby causing electrons to be emitted from its end surface.

A embodiment of a plane type display device 20 will be described below with reference to the drawings as an example of the field emission type cathode and the electron emitting apparatus according to the present invention. However, the present invention is not limited to the following embodiment.

Figure 6:
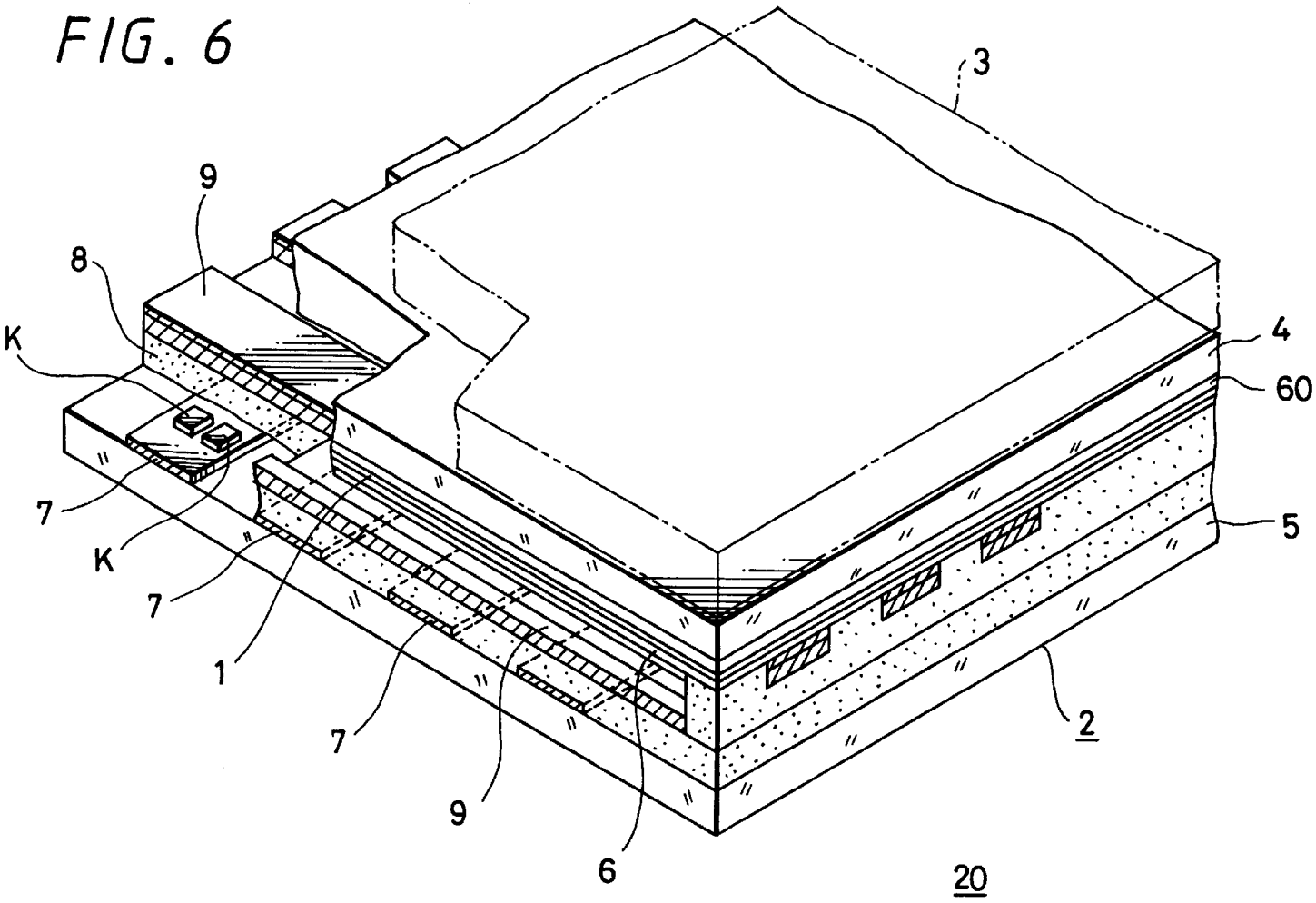
FIG. 6 is a schematic perspective view of an example of the plane type display device according to the present invention.

The plane type display device 20 shown in FIG. 6 is comprised of a plane type light emitting display body 2 having a light emitting fluorescent screen 1 and field emission type cathodes K arranged opposite thereto, and a plane type colour shutter 3 arranged adjacent or opposite to the front face of the fluorescent screen 1 on its arranged side.

Figure 1:
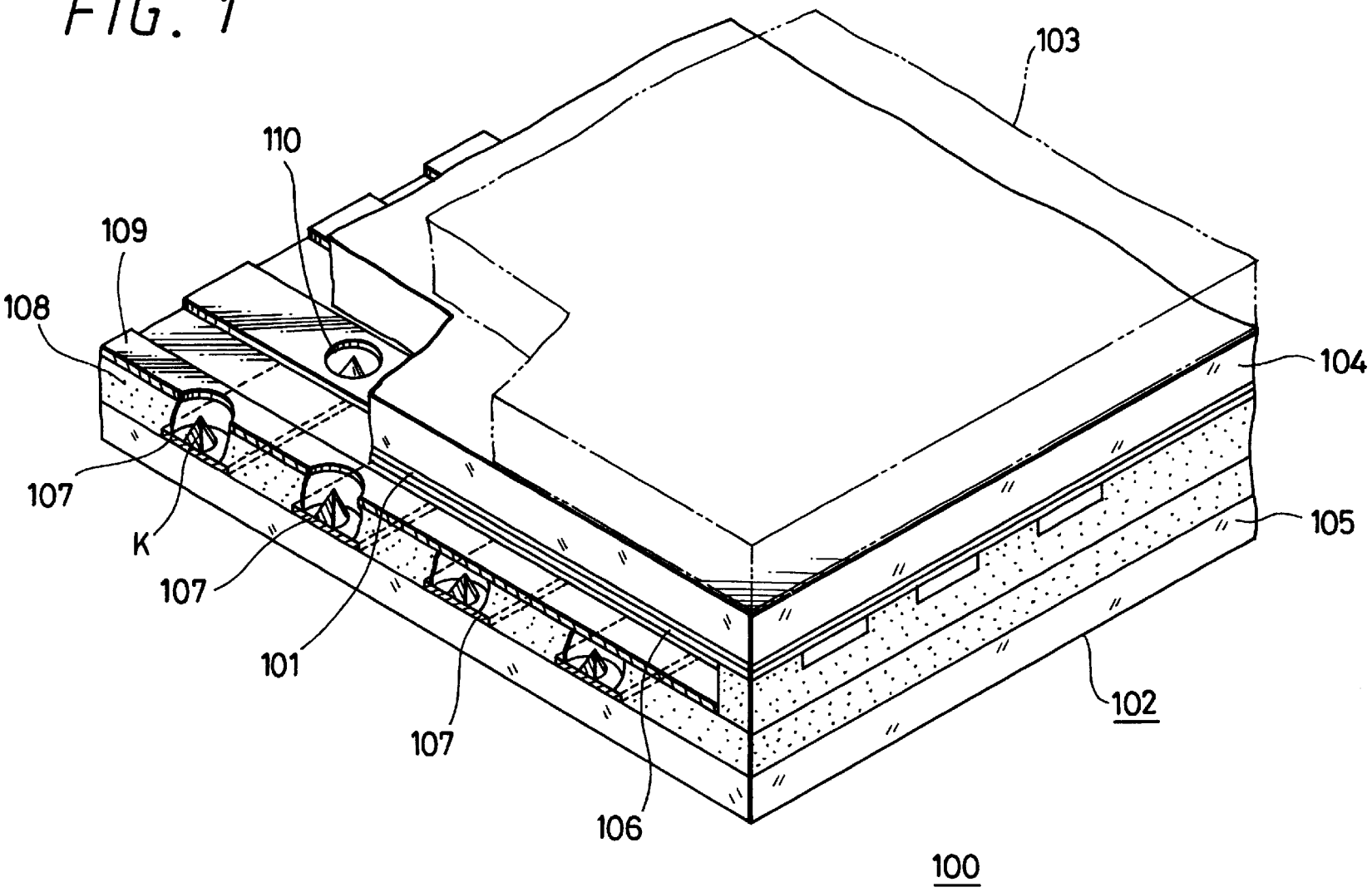
FIG. 1 is a schematic perspective view of an example of the plane type display device having the prior art structure.
Figure 2:
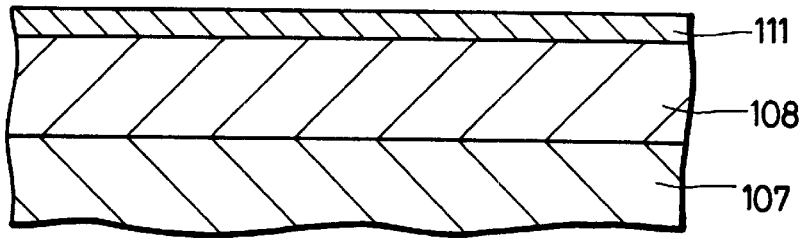
FIG. 2 is a manufacturing process diagram of an example of the conventional plane type display device.
Figure 3:
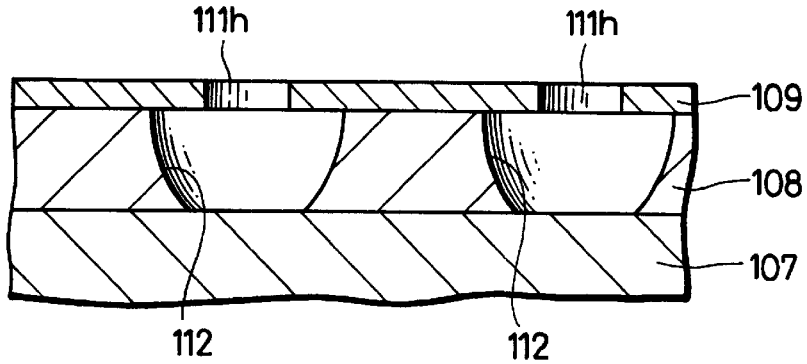
FIG. 3 is a manufacturing process diagram of an example of the conventional plane type display device.
Figure 4:
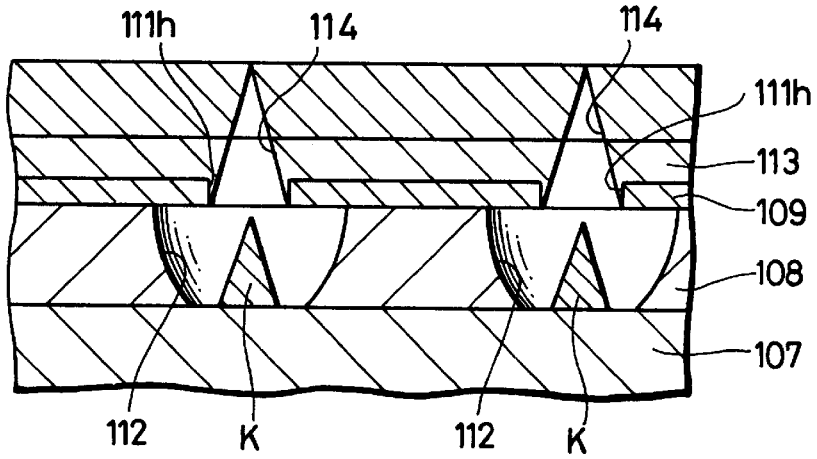
FIG. 4 is a manufacturing process diagram of an example of the conventional plane type display device.

The display device body 2 is constructed in the same way as described with FIG. 1 so that as shown in FIG. 6 a transparent front panel 4 and a rear panel 5 oppose to each other through a spacer (not shown) holding a predetermined space between both panels 4 and 5, and the periphery thereof is sealed airtightly by the glass frit, etc. to form a flat space between the panels 4 and 5.

On the inner surface of the front panel 4 is formed the light emitting fluorescent screen 1 which is made by applying beforehand a light emitting fluorescencer entirely, and its surface is coated with an anode metal layer 60 and a metal-backed layer 6 made of alminium film, etc. as in the ordinary cathode ray tube.

On the other hand, on the inner surface of the rear panel 5 are arranged and mounted in parallel a great number of cathode electrodes 7 which, for example, extend vertically in the shape of belts.

Grate electrodes 9 are arranged and mounted in parallel through an insulation layer 8, for example, in the horizontal direction nearly perpendicular to the extension direction of these cathode electrodes 7.

The field emission type cathode K is formed on each cathode electrode 7 and midway between the plural gate plural electrodes 9, respectively.

Figure 7:
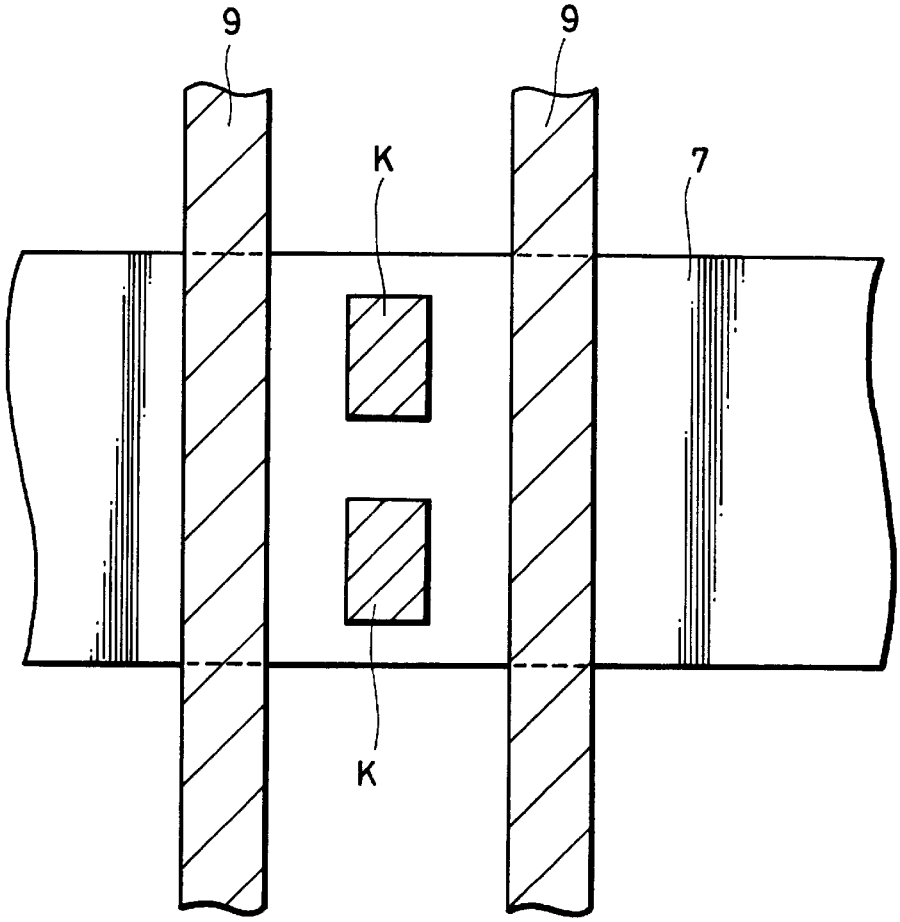
FIG. 7 is a schematic diagram representing the relative positional relationship among the cathode electrode, the gate electrode and the field emission type cathode.

FIG. 7 is a schematic diagram showing the relative positional relationship among the cathode electrode 7, the gate electrode 9 and the field emission type cathode K. Additionally, in FIG. 7, although an example in which two field emission type cathodes K are formed on the cathode electrode 7 between the gate electrodes 9 is shown, the present invention is not limited to this example.

Figure 8:
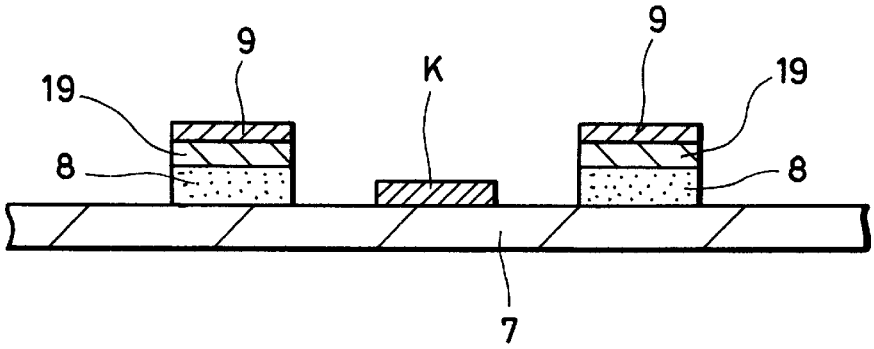
FIG. 8 is a schematic sectional diagram representing the relative positional relationship among the cathode electrode, the gate electrode and the field emission type cathode.

FIG. 8 is a schematic sectional diagram showing the relative positional relationship among the cathode electrode 7, the gate electrode 9 and the field emission type cathode K.

As is shown in FIG. 8, the gate electrode 9 can also be formed through a dielectric layer 19.

Figure 9:
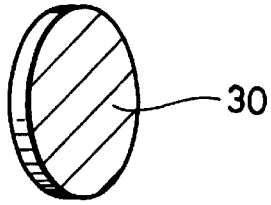
FIG. 9 is a schematic perspective view of the platelike particle forming the field emission type cathode K according to the present invention.
Figure 10:
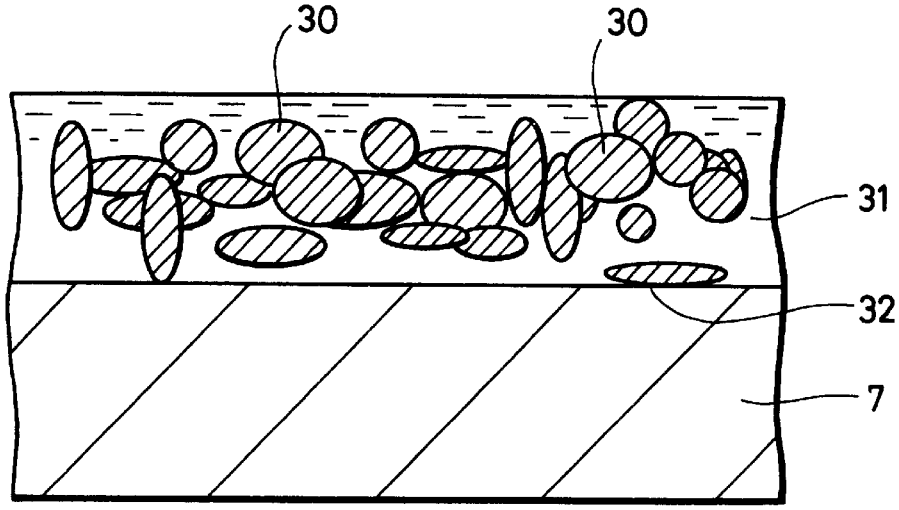
FIG. 10 is a manufacturing process diagram of an example of the field emission type cathode K according to the present invention.

This field emission type cathode K is composed of a pile of layers of platelike particles 30 each made of combined carbon, e.g. graphite, amorphous carbon, diamond-shape like carbon, and so forth, which has a shape as shown in FIG. 9. As concerns the particle 30, e.g. those having a diameter of 500 nm and a thickness of 20 nm or so may be employed.

This platelike particle forming the field emission type cathode K has, for example, a shape of almost circular plate, an average particle diameter of five $\mu$m or less, and an average aspect ratio (a value of the square root of an area of a platelike particle divided by its thickness) of five or more. Preferably, the particle diameter is three $\mu$m or less, the particle whose diameter is 0.1 $\mu$m or less, occupying 40 to 95 weight percent of whole platelike particles forming the cathode, the average diameter of platelike particles forming the field emission type cathode K being between 0.05 $\mu$m and 0.08 $\mu$m and the average aspect ratio (a value of the square root of an area of a platelike particle divided by its thickness) being ten or more.

In addition, the particle diameter is stokes diameter and was measured, e.g. by a centrifugal sedimentation method light transmission type particle size distribution apparatus.

The field emission type cathode K is composed of the pile of layers of platelike particles as shown in FIG. 9. As to a size of the particle 30, if its average diameter is greater than five $\mu$m, then the edge portion of an end surface of the layered pile will become so gradual that it will be difficult to make the efficient concentration of electric field and electron emission. Further, most of the particles preferably have the diameter of 0.1 $\mu$m or less. If an amount of the particles whose diameter is 0.1 $\mu$m or less is smaller than 40 weight percent, it will then be difficult to form a uniform coating film so that a shape of the cathode K will become undesirably non-uniform. Therefore, it is preferable that the average particle diameter is on the level of 0.05 to 0.08 $\mu$m. Additionally, the particle size distribution can be measured by the light transmission type particle size distribution measuring apparatus.

Where the curvature radius of the tip of field emission type cathode K is indicated by $\rho$, the electric field at the tip of cathode K by E, and a potential at the tip of cathode K by V, the following relational formula holds good.

$$E=V/(5\rho)$$

In this connection, consider a case where the potential V at the tip of cathode K is equal to a threshold voltage Vt of electron emission of the field emission type cathode K. A voltage of a cathode driving circuit is desirably between dozens of volts and one hundred volts from the viewpoint of performance and price of transistor. A threshold electric field $E_t$ corresponding to $V_t$ depends on the homogeneity. For metal materials it is $10^7$ [V/cm] or less. For carbonic system materials it is $10^6$ [V/cm] or less.

For example, if the threshold voltage $V_t$=10 [V] and $E_t$=$10^6$ [V/cm], then from the above formula follows $$\rho=10\ [V]/5\times10^6\ [V/cm]=0.02\ [\mu m]$$

This is the dimensional order of the particle in its thickness direction.

On the other hand, dimensions of the particle in its plate surface direction depend on the size of an emitter. The size of the emitter depends in turn on dimensions of a displayed pixel of the display device.

The dimensions of the displayed pixel depend on display dimensions and the density of pixels (resolution). In a computer display of XGA sized in 17 inches to 20 inches as typical example with high resolution, the number of pixels is 1024×768 and the size of one subpixel is approximately 60 [μm]×100 [μm].

Several tens to several hundreds of emitters are manufactured therein. Thus, the size of one emitter becomes about a dozen [μm] to several [μm]. It is necessary for size of particle to be submicron, i.e., 0.1 to 0.5 [μm] or so, in order to pattern precisely emitters of the size on this level.

Therefore, since ρ=0.02 [μm] as described above, the aspect ratio will be $$(0.1\ \text{to}\ 0.5)/0.02=5\ \text{to}\ 25$$

From the foregoing, the average aspect ratio is five or more, desirably ten or more.

An example of a process for manufacturing the field emission type cathode K according to the present invention, forming the plane type display device in the present invention will be described with reference to manufacturing process diagrams of FIG. 10 to FIG. 15.

However, the process for manufacturing according to the present invention is not restricted to the following example.

Figure 5:
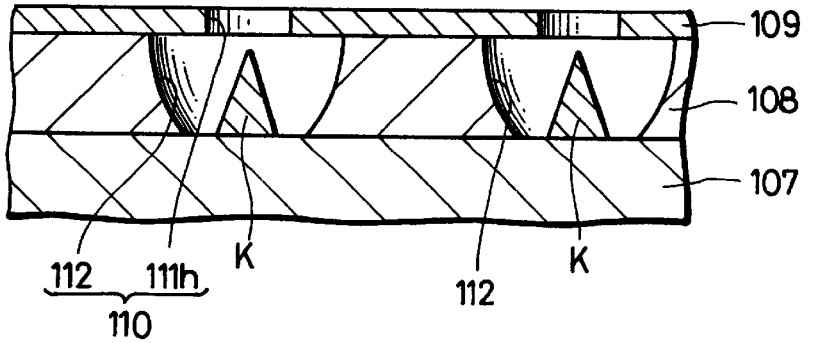
FIG. 5 is a manufacturing process diagram of an example of the conventional plane type display device.

To begin with, the scalelike particles shown in FIG. 9, namely, the platelike particles 30 are, for example, dispersed in a solvent 31 such as water, organic solvent and the like. The resulting substance is applied to a cathode forming surface 32, for example, by means of a spinner, a coater, and so forth as shown in FIG. 5.

Figure 11:
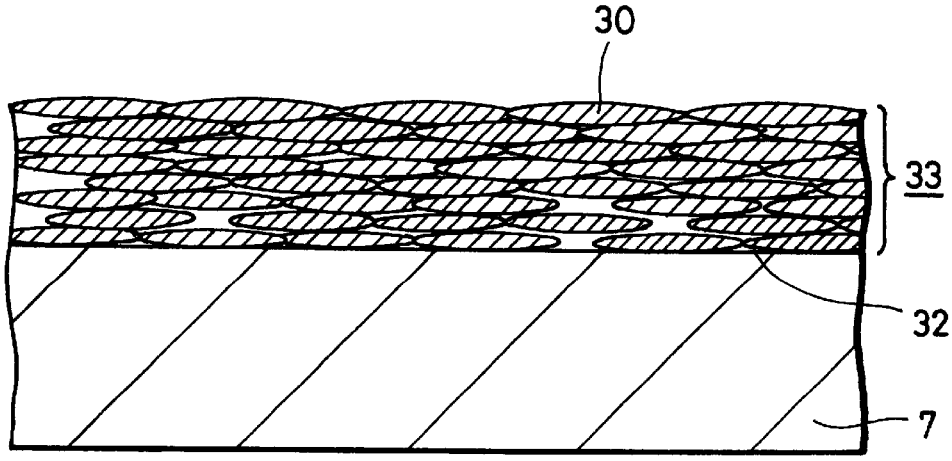
FIG. 11 is a manufacturing process diagram of an example of the field emission type cathode K according to the present invention.

Next, this is dried, e.g. by means of a hot plate or the like. In this case, the scalelike particles sink naturally and as is shown in FIG. 11, the scalelike particles, i.e. platelike particles 30 settle on the cathode forming surface 32 and pile in layers which lie nearly along the forming surface. Subsequently, it is prebaked to form a pile of layers 33 of platelike particles.

Figure 12:
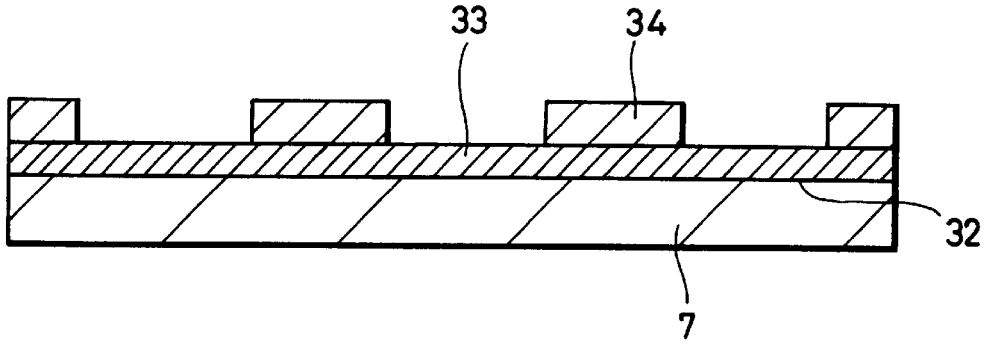
FIG. 12 is a manufacturing process diagram of an example of the field emission type cathode K according to the present invention.

Next, as shown in FIG. 12, a photoresist 34 is applied onto the layered pile 33 of platelike particles. This is dried and then pattern-exposed, e.g. by a high voltage mercury lamp to form into a predetermined pattern by developing it, e.g. using alkali developing solution.

Further, any one of the negative photoresist and the positive photoresist can be employed as this photoresist. For example, a novolac type of positive photoresist (PMER 6020 EK made by Tokyo Ohka Kogyo), etc. can be employed.

Figure 13:
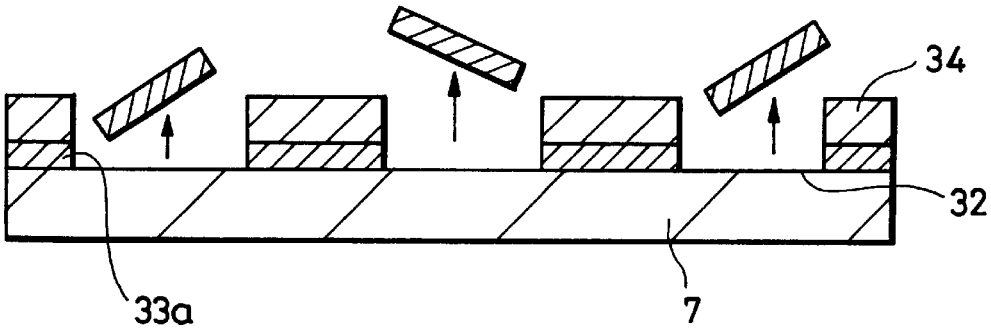
FIG. 13 is a manufacturing process diagram of an example of the field emission type cathode K according to the present invention.

Next, as shown in FIG. 13, the pattern-etching is carried out on the pile of layers 33 using the photoresist as a etching mask to form a layered pile pattern 33*a*.

Additionally, as an etching solution used for this etching any one of acid and alkali can be employed.

Particularly, if the platelike particle 30 is graphite, the pattern-etching can also be performed by blowing pure water with high pressure by a spray.

Figure 14:
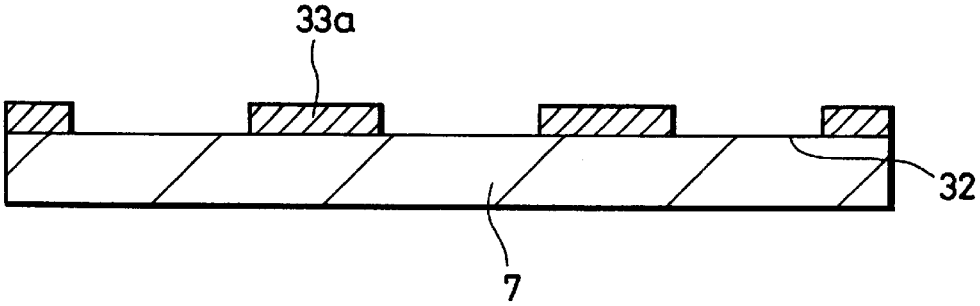
FIG. 14 is a manufacturing process diagram of an example of the field emission type cathode K according to the present invention.

Next, as shown in FIG. 14, the photoresist 34 is removed and then the post-baking is carried out to stabilize the layered pile pattern 33*a* of platelike particle.

Figure 15:
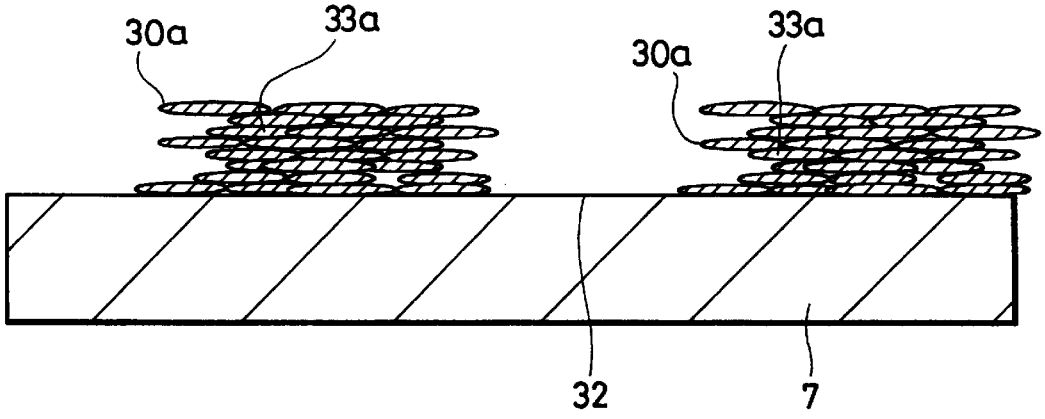
FIG. 15 is enlarged schematic diagram of the field emission type cathode K according to the present invention.

FIG. 15 is a enlarged schematic diagram of the layered pile pattern 33*a* of platelike particle.

As shown in FIG. 15, because the layered pile pattern 33*a* is such that the platelike particles are piled in layers, on its end surface appears an edge portion 30*a*, e.g. about 20 nm thick, of the platelike particle.

By creating this edge portion 30*a*, it is possible to form the field emission type cathode K having the edge portion whose curvature radius is 20 [nm] or less, for example, in case of the particle of 20 [nm] in thickness, which curvature radius is equal to or far smaller than that of the tip of the prior art field emission type cathode K, i.e. the conical cathode K which was shown in FIG. 1 and whose manufacturing method was described with FIG. 2 to FIG. 5.

In the above described manner, the field emission type cathodes K are formed on the cathode electrodes 7, above and across which the gate electrodes 9 are further formed to make the cathode structure, which is arranged in opposition to the fluorescent screen 1.

Figure 16:
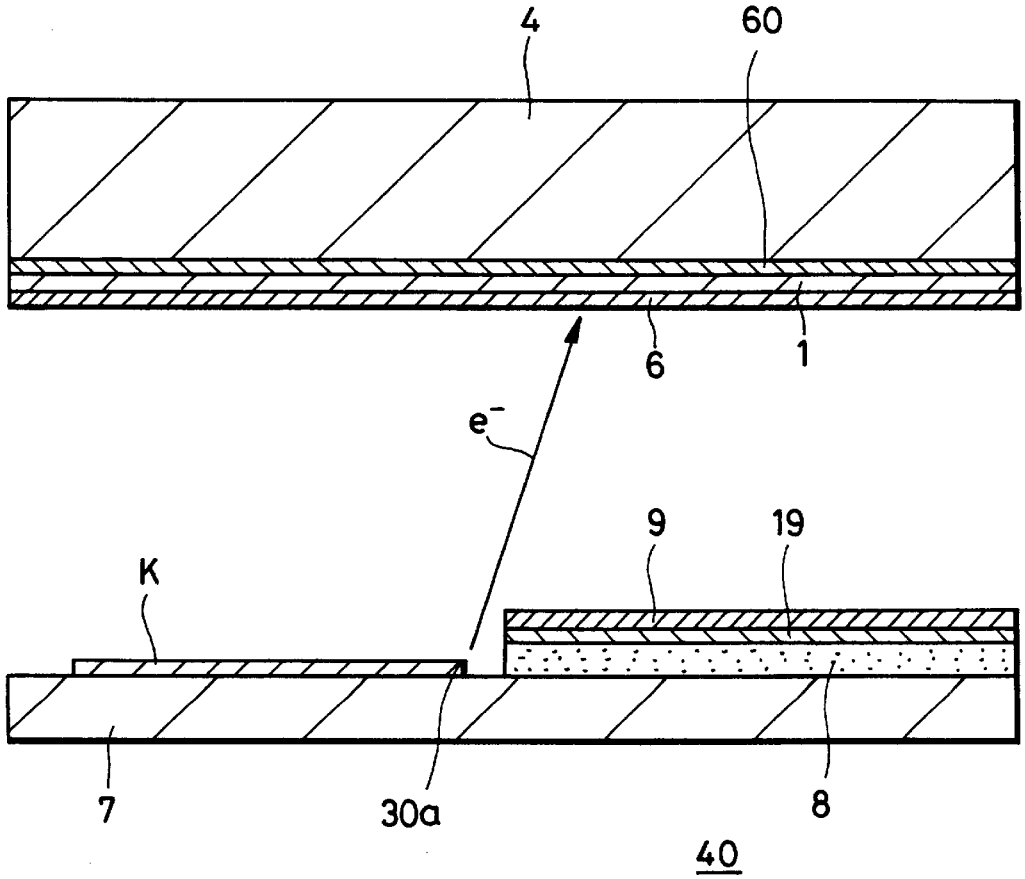
FIG. 16 is a schematic sectional diagram of the electron emitting apparatus having the field emission type cathode K according to the present invention.

In an electron emitting apparatus 40 having the thus formed field emission type cathode K, as shown in FIG. 16, a positive high anode voltage against the cathode is given to the fluorescent screen 1, i.e. the anode metal layer 60 and also between the cathode electrode 7 and the gate electrode 9, for example, a voltage which enables electrons to be emitted in sequence from the field emission type cathodes K at their intersections is impressed. For example, a voltage of 100 V relative to the cathode electrode 7 impressed to the gate electrode 9 is modulated in sequence according to the display contents, thus causing the resulting beam of electron $e^-$ from the edge portion 30*a* of the cathode K to be directed towards the fluorescent screen 1.

In this way, the white colour image of light emission pattern corresponding to each colour can be obtained in the time division style by the display device body 2, and at the same time the colour shutter 3 is switched in synchronism with that time division display to derive a light corresponding to each colour.

Thus, optical images of red, green and blue are derived sequentially to display a colour picture as a whole.

As described above, according to the electron emitting apparatus 40 of the present invention, by making the field emission type cathode K formed on the cathode electrode 7 into the multilayered structure in which the conductive platelike particles 30 are piled as shown in FIG. 15, it is possible to create the edge portion 30*a* of the end surface of the field emission type cathode K concentrating the electric field so as to have the sharpness which is equal to or more than that of the tip of conventional conical field emission type cathode K by the easy manufacturing process, thereby allowing electron to be emitted efficiently and thus allowing the electron emitting apparatus with high accuracy to be provided.

In the embodiment of FIG. 6, the display device can be constructed in such a manner that, in addition to the example having the white colour light emission fluorescent screen, the fluorescent screen of red, green and blue are each separated. Thus, the structure of display device can appropriately be altered.

Figure 18:
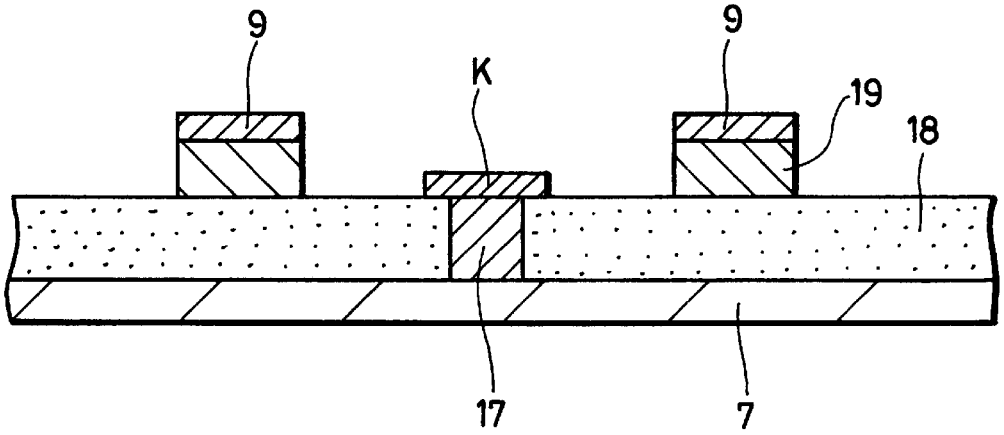
FIG. 18 is a schematic sectional diagram representing the relative positional relationship with the cathode electrode, the gate electrode and the field emission type cathode.

Having described the case where the field emission type cathode K is directly formed on the cathode electrode 7 in the above example shown in FIG. 6, the present invention is not limited to this example. As is shown in FIG. 18, it is also applicable to a case as well where an insulation layer 18 is entirely formed on the cathode electrode 7 and then a predetermined part of this insulation layer is bored, the field emission type cathode K being made conductive with the cathode electrode 7 lying under the bored part by connecting both of them each other through the bore with a conductive layer 17 made of tungsten or the like.

Also, having described in the aforesaid embodiment the case where, when forming the field emission type cathode K, the conducting platelike particles 30 are piled on the smooth plane, the present invention is not restricted to this example and is also applicable to a case as well where it is formed on a plane having a predetermined unevenness.

Figure 17:
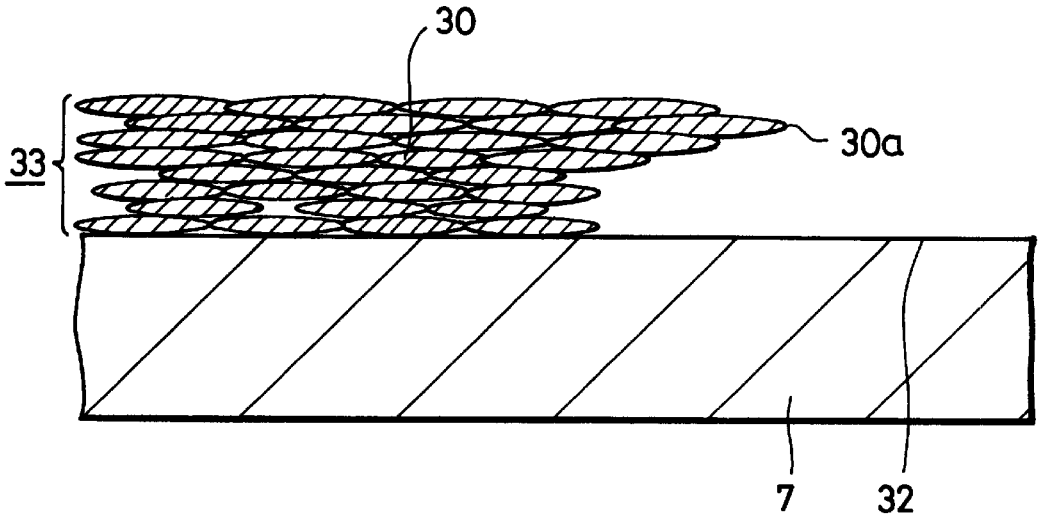
FIG. 17 is a enlarged schematic view of another example of the field emission type cathode K according to the present invention.

Furthermore, in the aforesaid embodiment, when pattern-etching the conductive platelike particles 30 to form the field emission type cathode K, by adjusting exposure conditions the field emission type cathode K of an inverse trapezoidal shape as shown in FIG. 17 can be formed.

According to the field emission type cathode and the electron emitting apparatus of the present invention, by making the field emission type cathode K formed on the cathode electrode 7 as the pile of layers 33 in which the conductive platelike particles 30 are piled in the multilayered structure, it will be possible to create the edge portion 30*a* of an end surface of the field emission type cathode K for concentrating the electric field with its sharpness which is equal to or more than that of the tip of the prior art conical field emission type cathode K in order to enable the efficient electron emission, thus allowing the electron emitting apparatus with high accuracy to be provided.

According to the process for manufacturing the electron emitting apparatus of the present invention, by making the field emission type cathode K formed on the cathode electrode 7 as the pile of layers 33 in which the conductive platelike particles 30 are piled in the mulilayered structure, it will be possible to form the edge portion 30*a* of end surface of the field emission type cathode K for concentrating the electric field with its sharpness which is equal to or more than that of the tip of the prior art conical field emission type cathode K by easy manufacturing processes, thereby enabling the efficient electron emission and the electron emitting apparatus with high accuracy to be provided.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A field emission type cathode characterized by comprising a multilayered structure in which conductive platelike particles are piled, wherein said platelike particles have a shape of nearly circular plate, said platelike particles having an average diameter of five $\mu$m or less and having an average aspect ratio of five or more, said average aspect ratio being a value of the square root of an area of a platelike particle divided by the thickness of the platelike particle.

2. A field emission type cathode according to claim 1, characterized in that said platelike particles are made of a combined carbon.

3. An electron emitting apparatus having a field emission type cathode arranged in opposition to a fluorescent screen, characterized in that said field emission type cathode has a multilayered structure in which conductive platelike particles are piled, and by applying a predetermined electric field, an electron is emitted from an end surface of said field emission type cathode, wherein said platelike particles forming said field emission type cathode have a shape of nearly circular plate, said platelike particles having an average diameter of five $\mu$m or less and having an average aspect ratio of five or more, said average aspect ratio being a value of the square root of an area of a platelike particle divided by the thickness of the platelike particle.

4. An electron emitting apparatus according to claim 3, characterized in that said platelike particles forming said field emission type cathode are made of a combined carbon.

* * * * *